US008575503B2

(12) United States Patent
Krebs et al.

(10) Patent No.: US 8,575,503 B2
(45) Date of Patent: Nov. 5, 2013

(54) OPERATING DEVICE FOR MANUALLY ACTUATING LIFTING DEVICES

(75) Inventors: Wolfgang Krebs, Wetter (DE); Thomas Bönker, Unna (DE); Giuliano Persico, Wetter (DE); Klaus-Dieter Oemus, Herner (DE); Stefan Elspass, Tönisvorst (DE); Anton Münzebrock, Dortmund (DE); Udo Gersemsky, Herdecke (DE)

(73) Assignee: Demag Cranes & Components GmbH, Wetter (DE)

( * ) Notice: Subject to any disclaimer, the term of this patent is extended or adjusted under 35 U.S.C. 154(b) by 230 days.

(21) Appl. No.: 13/130,129

(22) PCT Filed: Nov. 9, 2009

(86) PCT No.: PCT/EP2009/064859

§ 371 (c)(1),
(2), (4) Date: Jun. 23, 2011

(87) PCT Pub. No.: WO2010/057808

PCT Pub. Date: May 27, 2010

(65) Prior Publication Data

US 2011/0240447 A1 Oct. 6, 2011

(30) Foreign Application Priority Data

Nov. 19, 2008 (DE) ..... 10 2008 057 993

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |

(52) U.S. Cl.
USPC ..... 200/293

(58) Field of Classification Search
USPC ..... 200/293, 11 J, 5 R, 430, 440, 443, 453, 200/458, 459, 510, 520, 552, 341, 345
See application file for complete search history.

(56) References Cited

U.S. PATENT DOCUMENTS

| | | | |
|---|---|---|---|
| 2,795,144 | A | 6/1957 | Morse |
| 3,316,379 | A | 4/1967 | Clarke et al. |

(Continued)

FOREIGN PATENT DOCUMENTS

| | | |
|---|---|---|
| DE | 10331130 | 3/2005 |
| DE | 102008003913 | 1/2009 |

(Continued)

OTHER PUBLICATIONS

International Search Report and Written Opinion of the International Searching Authority from corresponding Patent Cooperation Treaty (PCT) Application No. PCT/EP2009/064859, mailed Jan. 18, 2010.

(Continued)

*Primary Examiner* — Edwin A. Leon
*Assistant Examiner* — Anthony R. Jimenez
(74) *Attorney, Agent, or Firm* — Gardner, Linn, Burkhart & Flory, LLP

(57) ABSTRACT

An operating device is provided for manually actuating lifting devices. The device includes at least one switching element arranged in a switch housing, wherein the switching element includes a tappet, which protrudes from the switch housing. The tappet is guided in a sleeve and is covered by a covering element having a threaded ring. The sleeve protrudes outside through an opening in the switch housing, and is held in the switch housing through a threaded joint. The covering element is screwed to the sleeve in a detachable manner through the threaded ring of the covering element. Optionally, a tool is provided for installing the covering element.

27 Claims, 4 Drawing Sheets

(56) References Cited

U.S. PATENT DOCUMENTS

| | | | | |
|---|---|---|---|---|
| 4,298,778 | A | 11/1981 | Beresford-Jones | |
| 6,791,047 | B1 * | 9/2004 | Skarlupka et al. | 200/335 |
| 7,705,258 | B2 * | 4/2010 | Geldmacher | 200/341 |
| 2003/0214816 | A1 | 11/2003 | Barlian | |
| 2005/0034966 | A1 | 2/2005 | Krebs et al. | |

FOREIGN PATENT DOCUMENTS

| | | |
|---|---|---|
| EP | 0423848 | 4/1991 |
| EP | 1345188 | 9/2003 |
| ES | 1018351 | 1/1992 |

OTHER PUBLICATIONS

International Preliminary Examination Report (IPER) of the INternational Searching Authority from corresponding PCT Application No. PCT Application No. PCT/EP2009/064859, mailed Nov. 18, 2010.

International Preliminary examination Report (IPER) for International Application No. PCT/EP2009/064859, which corresponds to the current application.

* cited by examiner

OPERATING DEVICE FOR MANUALLY ACTUATING LIFTING DEVICES

BACKGROUND OF THE INVENTION

The invention relates to operating devices for manually actuating lifting devices.

For instance, a switch for manually actuating lifting devices is known from German application laid open DE 103 31 130 A1. The switch has a switch housing, in which several spring-loaded switching elements—such as for the lifting and lowering functions of a lifting device—are arranged. Each switching element includes of an electrical push button switch and a mechanical pressure switch for its actuation. The mechanical pressure switch is basically made up of a switch tappet and a sleeve. The switch tappet is guided in the sleeve for actuating the electrical push button switch, configured as a microswitch. The switch tappet is buttressed against the push button or a floor of the switch housing by a spring element in the form of a helical spring. The pressure switch can be one-step or multiple-step in configuration, starting from an off position, the switch tappet can be moved into a first on position and then to at least one additional on position. Accordingly, corresponding electrical push buttons or multiple-step push buttons are then actuated by the switch tappet in each of the on positions. In the off position, the switch tappet protrudes furthest out from the sleeve and it is then moved in the direction of the sleeve to reach the first or the additional on positions. In the last on position, the switch tappet still protrudes from the sleeve so that it can be felt by the user's thumb.

Furthermore, from the Spanish utility model ES 101 83 51 U there is known another switch for the manual actuating of lifting devices, which likewise has switching elements arranged in a switch housing with electrical push buttons and a mechanical pressure switch. The mechanical pressure switch also has a switch tappet and a sleeve, in which the switch tappet is guided for an activation of the electrical push button. Furthermore, the pressure switch here is also sealed off from the switch housing with a flexible covering element. Before the flexible covering element is mounted, the sleeve provided with an outer thread is screwed into an opening in the front surface of the switch housing until a sealing ring, bearing against a peripheral rim on the outside of the sleeve, comes to bear against the inside of the front surface of the switch housing. The covering element is then screwed from the outside onto the rest of the outer thread protruding from the front surface of the switch housing until the covering element comes to bear flush against the front surface of the switch housing. For this, the covering element has an inwardly directed peripheral groove in the region of its connection opening, in which is inserted a connection ring having an inner thread.

The protective caps of the switching elements are often subjected to special strain and often need to be replaced on account of wear.

SUMMARY OF THE INVENTION

The present invention provides an operating device for manual actuating of lifting devices, in which the covering elements of the switching elements are easy to assemble and replace.

In connection with industrial applications it is desirable for the user to have to move through an actuating path—for example, with his thumb—between the off position and the respective on positions so that even when wearing gloves he can safely operate the switch. Furthermore, it is advantageous for the switching element to return by itself to the off position so that the guided movement is activated only as long as the operator holds the switching element in the on position against its restoring force.

According to one aspect of the invention, an operating device for manually actuating lifting devices includes at least one switching element arranged in a switch housing. The switching element includes a tappet, which protrudes from the switch housing, is guided in a sleeve, and is covered by a covering element having a threaded ring, wherein the sleeve protrudes outside through an opening in the switch housing, the sleeve is held in the switch housing through a threaded joint, and the covering element is screwed to the sleeve in a detachable manner through the threaded ring of the covering element, an easy installation and replacement capability for the covering elements of the switching elements is achieved in that the sleeve has an outwardly extending collar, which in the installed state bears against an outer surface of the switch housing, and the sleeve is held on the switch housing in a detachable manner by a fastening ring, which in the installed state bears against an inner surface of the switch housing.

The opening of the switch housing in order to replace a covering element can be avoided. This opening otherwise would constitute a special expense to be done with special care by a technician, so as to cause no damage to the installed electrical subassemblies and so that the switch housing has the necessary sealing action after being put together. To perform this work, the switch needs to be removed on site and taken to a repair shop. Also, for the assembly of the covering elements, the sleeve is held securely in the switch housing by the fastening ring. This simplifies the assembly process. Furthermore, the switching element remains functional even without the covering element.

According to another aspect of the present invention, the switch housing does not need to be opened for servicing: repair can be done at the site of use of the operating device by removing a damaged covering element and replacing it with a new one.

In another embodiment of the invention, a switch housing has two switching elements, each being two-step in configuration. Thus, one can use this to control a lifting device in the lifting and lowering direction and, owing to the two-step design, each switching element can be placed in a first on position such as for slow duty—and a second on position such as for fast duty. Such switches are also useful for control of traversing gears or cranes.

The mechanical pressure switches are each secured via a sleeve to the switch housing. For this, round openings are provided in a front surface of the switch housing, into which the pressure switches are inserted from the outside. So that the pressure switch does not drop inside the switch housing through the opening while being assembled, the sleeves of the pressure switches have an outward pointing peripheral collar at their outer end, which comes to bear against the front surface of the switch housing. In order to fasten the pressure switch against the switch housing, the inner end of the sleeve is provided with an external thread. A fastening ring such as a nut is screwed onto the external thread, which comes to bear against the inside of the front surface of the switch housing and thus tightens the collar against the front surface of the switch housing.

For industrial applications, the electrical push buttons and the pressure switches may be installed in a switch housing that is tight or sealed in order to protect against external influences and dirt. Furthermore, the switch housing is configured such that the switch tappets protrude from the switch housing, thus providing some play for the actuating path of the pressure switch.

In order to seal off the switch tappets protruding from the switch housing against the tight switch housing, the switch tappets are surrounded by a flexible covering element in the manner of a protective cap, which is tightly connected to the switch housing. For this, the covering element is configured with a round connection opening. Seen in cross section, the covering has a cross section somewhat like a truncated cone, the smaller base surface lying against the switch tappet and the larger base surface pointing toward the connection opening. In the region of the connection opening, the covering element has an inwardly pointing rim extending parallel to the smaller base surface of the covering element. This rim is dimensioned such that it has roughly the dimensions of the sealing surface of the collar of the sleeve facing the switch housing. Before the pressure switch is inserted into the opening of the switch housing, the covering element is inverted over the collar of the sleeve, after which the sleeve of the pressure switch is inserted into the round opening of the switch housing and then the fastening ring is tightened from the inside. The rim of the covering element is clamped in this way between the front surface of the switch housing and the sealing surface of the collar and thus the opening of the switch housing is closed tight. To prevent the rim from slipping out from the region between the collar and the front surface, the front surface rebounds in the manner of an annular recess in which the outer circumference of the rim of the covering element comes to bear.

Advantageously, it may be provided that the sleeve has a first outer thread and a second outer thread; the first outer thread and the second outer thread are separated from each other by the collar, in the installed state the fastening ring engages with the first outer thread and in the installed state the threaded ring engages with the second outer thread. In this way, the switching element is held securely in the switch housing.

Optionally, the sleeve is secured against twisting relative to the switch housing. For this, the sleeve preferably has a radially outwardly protruding lug in the area of the collar, which engages with a recess that is arranged in the switch housing. Thanks to this twist protection, the installing of the covering element does not remove or loosen the screw connection of the sleeve with the switch housing via the fastening ring.

Optionally, the threaded ring of the covering element is buttressed against an outer surface of the switch housing in the installed state.

In one embodiment, the covering element is fashioned as a hat with a connection ring, the threaded ring is enclosed by the connection ring, and one part of the connection ring is clamped between the outer surface of the switch housing and the threaded ring, which produces the sealing action. Moreover, a secure joint is ensured between threaded ring and connection ring.

Furthermore, the threaded ring can also have an outer toothing or toothed surface on its outer circumference and the connection ring an inner toothing or toothed surface on the inside. This accomplishes a secure transmission of the installation forces from the installation tool via the connection ring to the threaded ring.

Optionally, the switch housing has a recess with an encompassing wall in the region of the opening for the switching element, which lies opposite a lower part of the connection ring. This prevents the connection ring from being forced out from beneath the threaded ring, losing the sealing action.

Where the covering element is provided with an outer profile (e.g., a toothing or toothed surface) for an assembly tool in the region of its connection ring, the covering element can easily be screwed onto the sleeve and be loosened from it. The assembly tool has a corresponding inner profile (e.g., a toothing or toothed surface) to cooperate with the outer profile of the covering element. The outer profile on the connection ring can be easily reached from the assembly tool, since even in the installed state the outer profile on the connection ring is arranged outside of the region of the connection ring that lies opposite the encompassing wall. Thus, the required tightening torques for the threaded ring can be safely applied. Also, a covering element that is surrounded by neighboring switching elements and shape elements of the switch housing can be installed or removed with the assembly tool in the manner of a socket wrench. The switch housings have the shape elements to provide a protection against accidental actuating of the switching elements. To accomplish this protection, the switching elements are recessed in the shape elements of the switch housing in the form of depressions. Here as well, the covering elements can easily be manipulated with the assembly tool.

In addition, it is specified that the covering element in the region of its connection ring is configured as conically increasing in diameter in the direction of the switch housing. The form fit between assembly tool and connection ring is thus strengthened by pushing the assembly tool in the direction of the covering element.

Optionally, the connection ring has an inner toothing or toothed surface, which engages with an outer toothing or toothed surface of the threaded ring. In this way, the installation forces can be safely transmitted from the assembly tool to the connection ring and on to the threaded ring.

Optionally, the covering element is secured on the switch housing by an adhesive or bonding connection.

In regard to a tool for installation and disassembly of the aforementioned covering element of the operating device, it is proposed that the inner profile of the tool be configured conically in the axial activating direction of the switching element.

Depending on the configuration of the covering element, it can be provided advantageously that the tool has an inner profile shaped complementary to the outer profile of the connection ring in the manner of a socket wrench, the tool encloses the covering element while it is being installed, and/or the inner profile is configured as a toothing or toothed surface, with the flanks of the teeth being preferably more steep in the disassembly direction.

These and other objects, advantages and features of this invention will become apparent upon review of the following specification in conjunction with the drawings.

DESCRIPTION OF THE PREFERRED EMBODIMENTS

Figure 1:
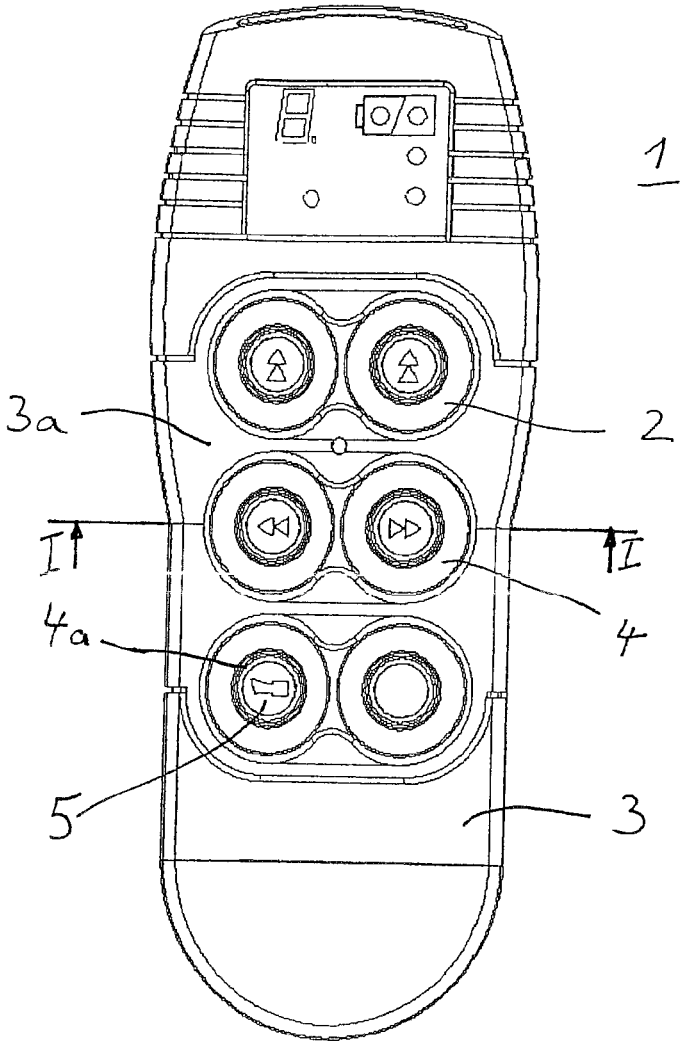
FIG. 1 is a top plan view of an operating device for manual actuating of lifting devices in accordance with the present invention.

FIG. 1 shows a top view of an operating device 1 for manual actuating of lifting devices. The operating device 1 serves for manual control of the movements of a crane, for example. For this, the operating device 1 is connected by an electrical cable, not shown, to the crane controls, or it can be connected to the crane controls without a cable, e.g., by a radio link. In the illustrated embodiment, the operating device 1, also known as a control switch, has a total of six switching elements 2, which are installed in a switch housing 3. Of the six switching elements 2, only a flexible and cap-shaped covering element 4 can be seen for each. Each covering element 4 has a flat actuating surface 4*a*, which can preferably be actuated by the user's thumb. A symbol carrying element 5 is fastened to the actuating surface 4*a*, preferably in the form of a stick-on label.

It is also conceivable for the symbol carrying element 5 to be a round or angular placard that is glued to the actuating surface 4*a* or clamped in appropriately provided grooves. The grooves in this case preferably have a continuous circumference to ensure a firm holding of the symbol carrying element 5.

The switching element 2 shown in FIG. 1 serves for the manual control of the drive unit of a crane. The six switching elements 2 are arranged in pairs alongside each other, and the three resulting pairs one above the other. The uppermost two switching elements 2 serve for the raising and lowering of a length of chain or cable; the middle two switching elements 2 serve to move the length of chain or cable in two directions along a girder by means of a traversing drive unit.

Of the two bottom switching elements 2, the left one is assigned a warning signal and the right one an emergency stop function. The upper four switching elements 2, by which the drive units of the crane are controlled, are configured as so-called two-stage switches, i.e., besides an off position there is a first on position and a second on position, in which each drive unit can be actuated in two speeds in one direction of movement. Basically, it is also possible to fashion the switching elements 2 so that drive units can be steered continuously.

Figure 2:
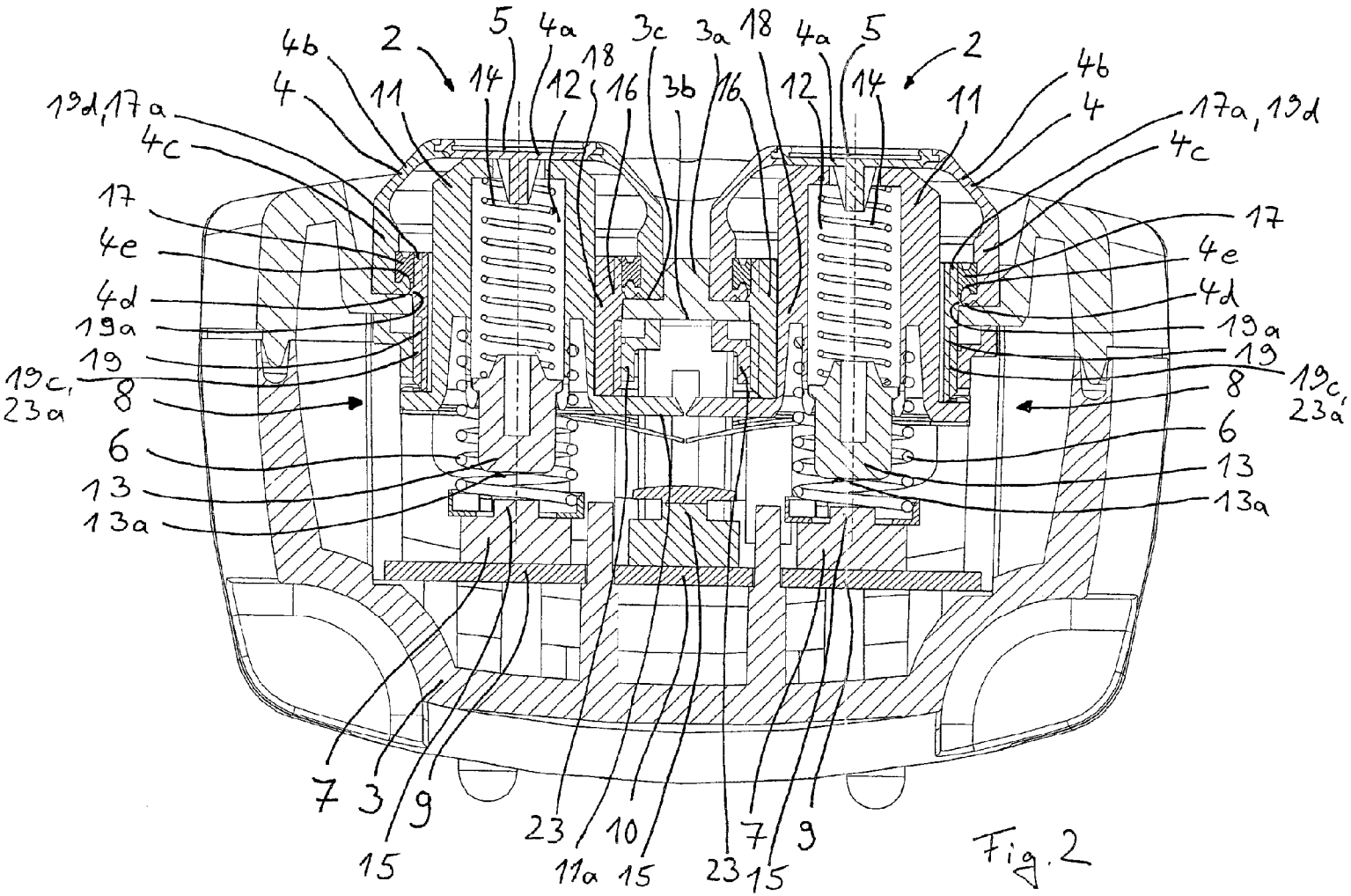
FIG. 2 is a sectional front elevation of the operating device, taken along intersection line I-I of FIG. 1.

FIG. 2 shows a front sectional view taken along line I-I of FIG. 1 and thus the two middle switching elements 2 for the traversing movement of the length of chain or cable in its two directions along a rail. These two switching elements 2 serve to activate the two different directions of movement of the lifting device, namely, left and right.

For safety reasons, the switching elements 2 of an operating device 1 for the manual actuating of lifting devices are designed so that a switching element 2, once activated, returns at once to the off position again once no more pressure is applied to the switching element 2. For this purpose, each switching element 2 is biased by a spring element 6 in the direction of the switched-off basic position.

As is further evident from FIG. 2, each of the two switching elements 2 includes a first electrical microswitch 7 as well as a series-connected pressure activation mechanism 8, by which the first microswitch 7 can be actuated. The conventional first microswitch 7 is directly soldered on an electrical circuit board 9, which is supported in the switch housing 3. By a microswitch is meant a miniaturized switching element for the switching of signal pathways with spring-loaded electrical contacts, which is switched by key activation with a short stroke. Microswitches can ideally be placed automatically on electrical circuit boards and require little installation space.

Due to this spatial separation of the actual electrical switch by the first micro switch 7 from the mechanical switching by means of the pressure activation mechanism 8, it becomes possible to use microswitches 7 that require only small switching paths and low switching forces. The large switching paths of at least 5 mm or so that are prescribed for a safe handling, distinct locking positions for fast and slow duty, and easily perceived switching forces can be easily and inexpensively accomplished in this embodiment by the kinematics of the pressure activation mechanism 8 that is connected in series to the microswitch 7.

The sample embodiment shown for an operating device for the manual actuating of lifting devices is furthermore configured such that another commonly-shared second electrical microswitch 10 is assigned to the pairs of upper and middle switching elements 2, by which a fast duty of the traversing movement of the length of chain or cable can be activated for the particular direction of movement. This second common microswitch 10 is activated by the respective pressure activation mechanism 8 for the desired direction of movement. Of course, it is also possible to assign its own second microswitch 10 to each switching element 2.

In any case, the pressure activation mechanism 8 is designed so that the second microswitch 10 can only be actuated in time sequence after the actuation of one of the first microswitches 7, that is, the lifting device can be switched first to the slow lifting or lowering duty or traversing duty before the fast duty can be switched on by activating the second microswitch 10.

To execute the consecutive switching function, namely, the actuation of the first electrical microswitch 7 of the switching element 2 on the one hand and the subsequent actuation of the second microswitch 10 on the other hand, the pressure activation mechanisms 8 of the switching elements 2 each include a tappet 11, biased by the spring element 6 with respect to the corresponding electrical switching means in the form of the first microswitch 7 of the switching element 2, and an inner tappet 13 that is led in a borehole 12 of the tappet 11, while the inner tappet 13 is buttressed against the tappet 11 by a spring element 14 mounted in the borehole 12. In this way, the inner tappet 13 can move coaxially in the tappet 11.

The actuating of the above-described operating device 1 for manual actuating of lifting devices is done as follows:

While exerting a pressure on the covering element 4 that spans a switching element 2, the pressure is transmitted to the tappet 11 of the pressure activation mechanism 8 and the tappet 11 moves against the restoring force of the spring element 6 in the direction of the corresponding first electrical microswitch 7, especially its switch tappet 15, of the switching element 2. The inner tappet 13 mounted via the spring element 14 in the tappet 11 is carried along unloaded during this movement, until the inner tappet 13 conies up against the first microswitch 7 or its switch tappet 15 by its bearing surface 13*a* and activates the electrical circuit. The inner tappet 13 is mounted coaxially to the switch tappet 15 of the first microswitch 7 in this process.

If further pressure is now exerted on the tappet 11 of the pressure activation mechanism 8, this pressure has the effect of compressing the spring element 14 by the inner tappet 13 lying against the first microswitch 7, so that the tappet 11 is pressed further into the switch housing 3 against the restoring force of the spring element 6, until a bearing surface 11*a* of the tappet 11 comes up against the switch tappet 15 of the second microswitch 10 and thus activates the fast duty.

To prevent moisture and/or dirt from getting into the switch housing 3, the pressure activation mechanisms 8 are sealed off from the outside of the switch housing 3 with the flexible covering element 4 already shown in FIG. 1 in the manner of a protective cap. The covering element 4 is a hat-shaped or truncated conical part with a flat actuating surface 4*a*, adjoined by an encompassing side wall 4*b* of elastic plastic, conically expanding in the direction of the switch housing 3. The actuating surface 4*a* is configured as a hard circular top of plastic or metal, intimately joined to the material of the side wall 4*b* and resting on the tappet 11 of the pressure activation mechanism 8. The actuating surface 4*a* absorbs the actuating force when the pressure activation mechanism 8 or its tappet 11 is depressed, and at the same time it is the carrier of the symbol carrying element 5, by which the control command assigned to the switching element 2 is symbolized.

The covering element 4 has a circular connection opening 16 at its end opposite the actuating surface 4*a*, being bounded by an encompassing connection ring 4*c*. The connection ring 4*c* adjoins the end of the side wall 4*b* opposite the actuating surface 4*a* and extends from the side wall 4*b* inwardly in the direction of the connection opening 16. Thus, the connection ring 4*c* forms a flat annular sealing surface 4*d* facing the switch housing 3 and an opposite, likewise flat annular connection surface 4*e* facing away from the switch housing 3. The sealing surface 4*d* and the connection surface 4*e* lie opposite and turned away from each other.

Furthermore, the connection ring 4*c* encloses in U-shaped or L-shaped fashion a threaded ring 17, which has an essentially rectangular cross section and an internal thread 17*a* on its inner circumference. The threaded ring 17 is form-fitted and held in the elastic connection ring 4*c* of the covering element 4.

For the fastening of the switching elements 2 in the switch housing, there are six round openings 18 arranged in a front surface 3*a* of the switch housing 3, into which the pressure activation mechanism 8 is inserted from the outside. For this, the pressure activation mechanism 8 has a cylindrical sleeve 19, in which the tappet 11 is held and led movably between its end positions. So that the sleeve 19 is not pushed from the outside through the respective opening 18, it has in its middle region a continuous annular collar 19*a*. Thus, the collar 19*a* extending radially outward from the sleeve 19 forms a second annular surface 19*b*, which in the installed state of the switch element 2 comes to rest against the outer surface 3*c* of the front surface 3*a*, which bounds the opening 18 for the sleeve 19.

In order to hold the pressure activation mechanism 8 in the respective opening 18, the region of the sleeve 19 bordering on the collar 19*a* and extending inward across the inner surface 3*b* of the front surface 3*a* of the switch housing 3 has a first external thread 19*c*. Thus, the sleeve 19 is also at the same time a housing pass-through for the tappet 11. On the first external thread 19*c* of the sleeve 19 is a fastening ring 23 with its internal thread 23*a*. The fastening ring 23 is steplike in cross section and divided into a first annular segment 23*c* and a second annular segment 23*d* (see FIG. 3). The first annular segment 23*c* has a smaller diameter than the second annular segment 23*d*. The diameter of the first annular segment 23*c* is chosen such that its internal thread 23*a* is matched to the first external thread 19*c* of the sleeve 19. Furthermore, the diameter of the second annular segment 23*d* is chosen such that its bearing surface 23*b* lies opposite the connection ring 4*c* of the covering element 4 and bears against the inner surface 3*b* of the switch housing 3 along its entire circumference. Thus, a recess 25 for a lug 24 is only slightly overlapped.

Due to the screwed-on fastening ring 23, the collar 19*a* is pressed by its annular surface 19*b* against the outer surface 3*c* of the front surface 3*a* of the switch housing 3 and the fastening ring 23 is pressed by its bearing surface 23*b* against the inner surface 3*d* of the switch housing 3. The inner surface 3*b* of the front surface 3*a*, the outer surface 3*c* of the front surface 3*a*, the annular surface 19*b* of the collar 19*a* and the bearing surface 23*b* of the fastening ring 23 are oriented basically parallel to each other.

Furthermore, the region of the sleeve 19 bordering on the collar 19*a* and extending outward across the outer surface 3*c* of the front surface 3*a* of the switch housing 3 has a second external thread 19*d*. On the second external thread 19*d* of the sleeve 19 is screwed the covering element 4 by its threaded ring 17. In this way, the sealing surface 4*d* of the connection ring 4*c* is pressed against the outer surface 3*c* of the switch housing 3 and the threaded ring 17 against the connection surface 4*e* of the connection ring 4*c*. The sealing surface 4*d* of the connection ring 4*c*, the outer surface 3*c* of the switch housing 3, the pressing surface of the threaded ring 17 and the connection surface 4*e* of the connection ring 4*c* are oriented basically parallel to each other. Thus, the opening 18 is tightly closed by the covering element 4 with the threaded ring 17.

Due to this design configuration, the functions of mechanical fastening of the switching element 2 in the switch housing 3 and sealing off of the switching element 2 from the switch housing 3 are separated from each other. The fastening ring 23 takes charge of the mechanical fastening and the threaded ring 17 of the sealing.

Figure 3:
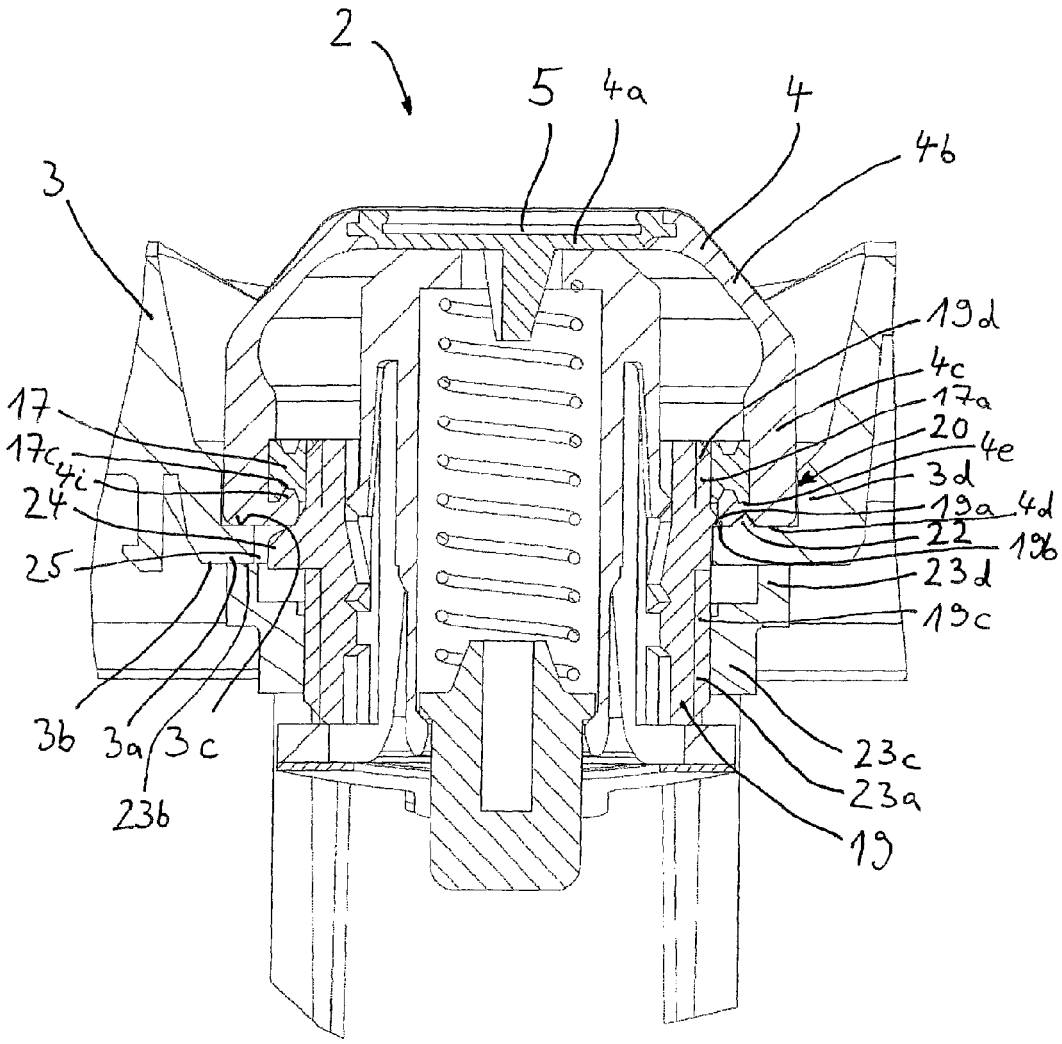
FIG. 3 is an enlarged detail view of a portion of FIG. 2 taken from the region of a switching element.

FIG. 3 shows an enlarged feature of FIG. 2 from the region of the left switching element 2 and the corresponding covering element 4 with the threaded ring 17. From this enlargement it is easier to recognize that the front surface 3*a* of the switch housing 3 is round in the region of the openings 18 for the switching elements 2 and has recesses 20 adjoining the margin of the openings 18 that are bounded by a circumferential wall 3*d*, which extends perpendicularly and upward from the outer surface 3*c*. The inner diameter of the recesses 20 is designed such that it is roughly the same or slightly larger, i.e., up to around 1 mm, preferably 0.15 mm, than the outer diameter of the connection ring 4*c*. This slight spacing effectively prevents the connection ring 4*c* from slipping out underneath the threaded ring 17. The depth of the recess 20 is chosen such that around half of the connection ring 4*c* protrudes upward from the recess 20.

Moreover, the front surface 3*a* of the switch housing 3 is provided with a peripheral trapezoidal projection 22, which "digs in" from the bottom in the covering element 4 in the region of the sealing surface 4*d* when assembled, so that the covering element 4 is fixed horizontally in its position.

It is also noticeable from FIG. 3 that the threaded ring 17 has a radially encircling groove 17*c*, looking in the lengthwise direction of the sleeve 19, on each of its top side and its bottom side, having a rounded trapezoidal cross section. In corresponding fashion, a complementary shaped thickening 4*i* with rounded trapezoidal cross section protrudes from the sealing surface 4*d* of the covering element 4, which in the assembled state of the covering element 4 engages by form-fitting with the groove 17*c* of the threaded ring 17.

In addition, it can be provided that the covering element 4 is secured to the switch housing 3 by an adhesive or bonding connection. In particular, such an adhesive or bonding connection is provided between the sealing surface 4*d* of the covering element 4 and the outer surface 3*c* of the switch housing 3.

Figure 4:
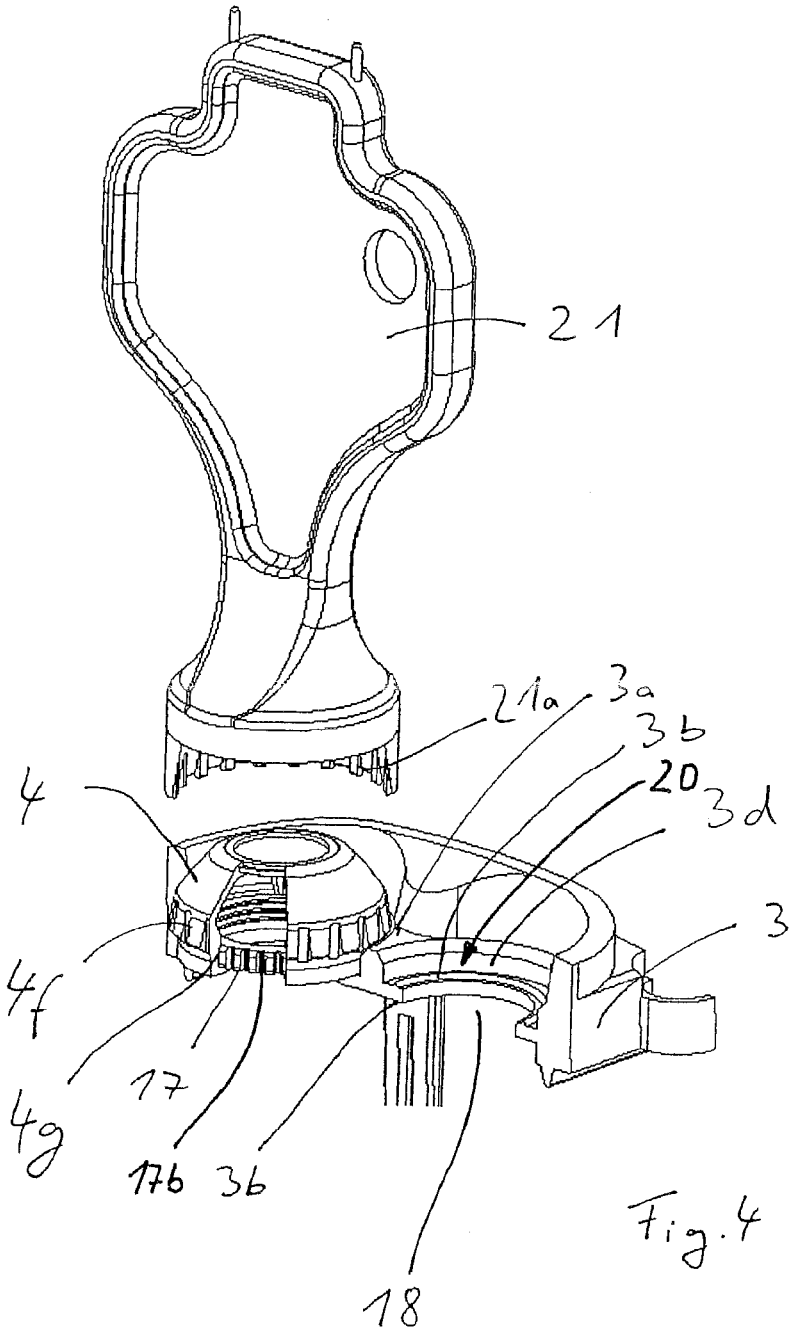
FIG. 4 is a perspective detail view of a covering element of a switching element, shown together with an assembly tool.

FIG. 4 shows a perspective detail view of a covering element 4 and a cutout from a front surface 3*a* of a switch housing 3 together with an assembly tool 21. It is evident that the connection ring 4*c* is configured with an outer profile 4*f* in its upper region not surrounded by the wall 3*d* of the recess 20. The assembly tool 21 has an inner profile 21*a* shaped complementary to the outer profile 4*f* in the manner of a socket wrench, so that the covering element 4 can be easily screwed onto the second external thread 19*d* of the sleeve 19 and also be loosened afterwards for a replacement. With the assembly tool 21, which encloses the covering element 4 during its installation, the required tightening torque can thus be applied for a secure fastening of the covering element 4 and a sealing of the switch housing 3 and transmitted to the threaded ring 17 on the inside.

To prevent a twisting of the sleeve 19 when screwing on the covering element 4, the sleeve 19 has a lug 24 (see FIG. 4) bordering on the collar 19*a*, which engages with a corresponding recess 25 on the switch housing 3 in the region of the opening 18 to prevent twisting. The lug 24 is triangular in shape seen in top view, i.e., the lengthwise direction of the sleeve 19, and extends with its tip radially outward away from the sleeve 19. As compared to the encircling collar 19*a*, the lug 24 protrudes from the surface of the sleeve 19 by a multiple more. The lug 24 borders on the recess 25. Furthermore, the recess 25 has a shape complementary to the lug, so that the lug 24 is held almost by form fitting in the recess 25. To simplify the installation, a play in the form of a gap remains between the lug 24 and the recess 25.

The assembly tool 21 is preferably made of plastic by injection molding and is placed on the covering element 4 with only slight space required, coaxially to the direction of activation of the switching element 2. Thus, even with switching elements 2 arranged alongside each other in recesses 20, the installation is possible with no problem. The inner profile 21*a* and the outer profile 4*f* are conically shaped in the axial direction of activation of the switching element 2, so as to intensify by axial pressure the forces transmitted in the circumferential direction by the assembly tool 21.

Advantageously, the inner profile 21*a* and the outer profile 4*f* are fashioned as gear teeth, and preferably the flanks of the teeth are steeper in the direction of disassembly, so as to apply a greater force with the assembly tool 21 when disassembling the covering elements 4.

Moreover, one notices from FIG. 4 that the threaded ring 17 also has a circumferential external toothing or toothed surface 17*b* on the outside and the connection ring 4*c* an internal toothing or toothed surface 4*g* on the inside. This accomplishes a secure transmission of the assembly forces from the assembly tool 21 to the connection ring 4*c* and on to the threaded ring 17.

Basically, it is also possible to do without the inner profile 21*a* of the assembly tool 21 and the outer profile 4*f* of the covering element 4 and configure the assembly tool 21 and the covering element 4 as conically increasing in the axial direction of activation of the switching element 2.

Besides the option depicted, it is also possible to configure the second microswitch 10 for continuous speed control of the drive units of a hoisting gear in the second switch stage by a Hall sensor interacting with a magnet. Such a special design for transformation of the movement path into an electric signal is known from DE 44 12 557 C2.

Suitable fields of use for such a two-stage switch include radio or cable-operated manual control units for cranes, construction machinery, or similar industrial machines.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. An operating device for manually actuating lifting devices, said operating device comprising:

a switch housing having an opening, an inner surface, and an outer surface;

a sleeve disposed in the opening of the switch housing and protruding outwardly from the opening, wherein the sleeve includes a first outer thread and a second outer thread, with an outwardly-extending collar positioned between the first and second outer threads, the collar bearing against the outer surface of the switch housing when the collar is in an installed state;

a fastening ring for coupling the sleeve to the switch housing in a detachable manner, wherein the fastening ring bears against the inner surface of the switch housing and engages with the first outer thread of the sleeve when the fastening ring is in an installed state;

a threaded ring at the sleeve, wherein the threaded ring engages with the second outer thread of the sleeve when the threaded ring is in an installed state;

a covering element connected to the sleeve and fastened to the threaded ring; and at least one switching element arranged in the opening of the switch housing, the switching element including a tappet that protrudes from the switch housing, is guided in the sleeve, and is covered by the covering element.

2. The operating device according to claim 1, wherein the sleeve is secured against twisting relative to the switch housing.

3. The operating device according to claim 2, wherein the switch housing includes a recess and the sleeve includes a radially outwardly protruding lug in the area of the collar, the lug configured to engage the recess of the switch housing.

4. The operating device according to claim 1, wherein the threaded ring is buttressed against the outer surface of the switch housing in the installed state.

5. The operating device according to claim 1, wherein the covering element is fashioned as a hat with a connection ring, the threaded ring is enclosed by the connection ring, and one part of the connection ring is clamped between the outer surface of the switch housing and the threaded ring.

6. The operating device according to claim 5, wherein the switch housing has a recess with an encompassing wall in the region of the opening for the switching element, which lies opposite a lower part of the connection ring.

7. The operating device according to claim 5, wherein the covering element has an outer profile configured for engagement by an assembly tool in the region of the connection ring.

8. The operating device according to claim 7, wherein the outer profile of the covering element is arranged outside of the part of the connection ring that lies opposite the encompassing wall.

9. The operating device according to claim 1, wherein the covering element in the region of the connection ring is configured as conically increasing in diameter in the direction of the switch housing.

10. The operating device according to claim 1, wherein the threaded ring has a toothed outer surface and the connection ring has a toothed inner surface that engages with the toothed outer surface of the threaded ring.

11. The operating device according to claim 1, wherein the covering element is secured on the switch housing by an adhesive or bonding connection.

12. The operating device according to claim 4, wherein the threaded ring has a toothed outer surface and the connection ring has a toothed inner surface that engages with the toothed outer surface of the threaded ring.

13. The operating device according to claim 4, wherein the covering element is fashioned as a hat with a connection ring, the threaded ring is enclosed by the connection ring, and one part of the connection ring is clamped between the outer surface of the switch housing and the threaded ring.

14. The operating device according to claim 13, wherein the switch housing has a recess with an encompassing wall in the region of the opening for the switching element, which lies opposite a lower part of the connection ring.

15. The operating device according to claim 14, wherein the covering element has an outer profile configured for engagement by an assembly tool in the region of the connection ring.

16. The operating device according to claim 15, wherein the outer profile of the covering element is arranged outside of the part of the connection ring that lies opposite the encompassing wall.

17. The operating device according to claim 16, wherein the covering element in the region of the connection ring is configured as conically increasing in diameter in the direction of the switch housing.

18. The operating device according to claim 17, wherein the threaded ring has a toothed outer surface and the connection ring has a toothed inner surface that engages with the toothed outer surface of the threaded ring.

19. The operating device according to claim 18, wherein the covering element is secured on the switch housing by an adhesive or bonding connection.

20. The operating device according to claim 3, wherein the threaded ring is buttressed against the outer surface of the switch housing in the installed state.

21. The operating device according to claim 20, wherein the covering element is fashioned as a hat with a connection ring, the threaded ring is enclosed by the connection ring, and one part of the connection ring is clamped between the outer surface of the switch housing and the threaded ring.

22. The operating device according to claim 21, wherein the switch housing has a recess with an encompassing wall in the region of the opening for the switching element, which lies opposite a lower part of the connection ring.

23. The operating device according to claim 22, wherein the covering element has an outer profile configured for engagement by an assembly tool in the region of the connection ring.

24. The operating device according to claim 23, wherein the outer profile of the covering element is arranged outside of the part of the connection ring that lies opposite the encompassing wall.

25. The operating device according to claim 24, wherein the covering element in the region of the connection ring is configured as conically increasing in diameter in the direction of the switch housing.

26. The operating device according to claim 25, wherein the threaded ring has a toothed outer surface and the connection ring has a toothed inner surface that engages with the toothed outer surface of the threaded ring.

27. The operating device according to claim 26, wherein the covering element is secured on the switch housing by an adhesive or bonding connection.

* * * * *

UNITED STATES PATENT AND TRADEMARK OFFICE

CERTIFICATE OF CORRECTION

PATENT NO. : 8,575,503 B2
APPLICATION NO. : 13/130129
DATED : November 5, 2013
INVENTOR(S) : Wolfgang Krebs et al.

It is certified that error appears in the above-identified patent and that said Letters Patent is hereby corrected as shown below:

In the Specification

Column 1
Line 21, insert --i.e.,-- after "configuration,"

Column 5
Line 63, "micro switch" should be --microswitch--

Column 6
Line 46, "conies" should be --comes--

Signed and Sealed this
Eighteenth Day of November, 2014

Michelle K. Lee

Michelle K. Lee
*Deputy Director of the United States Patent and Trademark Office*